US007104093B2

(12) United States Patent
Ling et al.

(10) Patent No.: US 7,104,093 B2
(45) Date of Patent: Sep. 12, 2006

(54) CABLE LOCK

(75) Inventors: Renny Tse-Haw Ling, Taipei Hsien (TW); Chang-Chiang Yu, Taipei Hsien (TW)

(73) Assignee: Sinox Co., Ltd., Chung-Ho (TW)

( * ) Notice: Subject to any disclaimer, the term of this patent is extended or adjusted under 35 U.S.C. 154(b) by 0 days.

(21) Appl. No.: 10/908,780

(22) Filed: May 26, 2005

(65) Prior Publication Data

US 2006/0075794 A1 Apr. 13, 2006

(30) Foreign Application Priority Data

Oct. 7, 2004 (TW) ..... 93215928 U

(51) Int. Cl.
*E05B 37/02* (2006.01)

(52) U.S. Cl. ..... 70/30; 70/25; 70/312

(58) Field of Classification Search ..... 70/14, 70/18, 20, 25, 30, 52, 58, 233, 312
See application file for complete search history.

(56) References Cited

U.S. PATENT DOCUMENTS 2,190,661 A * 2/1940 Hauer ..... 70/49
4,290,280 A * 9/1981 Yun ..... 70/52
4,610,152 A * 9/1986 Duringer ..... 70/30
5,560,232 A * 10/1996 Chen ..... 70/30
6,470,718 B1 10/2002 Yang
6,526,785 B1 * 3/2003 Asenstorfer et al. ..... 70/30
6,931,894 B1 * 8/2005 Yu ..... 70/30
6,997,023 B1 * 2/2006 Huang ..... 70/30
2005/0092037 A1 * 5/2005 Meekma et al. ..... 70/30

FOREIGN PATENT DOCUMENTS

GB 2240578 A * 8/1991

* cited by examiner

*Primary Examiner*—Brian E. Glessner
*Assistant Examiner*—Christopher Boswell
(74) *Attorney, Agent, or Firm*—Winston Hsu

(57) ABSTRACT

A cable lock includes a lock body and a belt which constitutes a closed loop. The closed loop is adjustable when the lock body is in an unlock condition. When the lock body is switched to a lock condition, the belt is restricted so that the closed loop is not adjustable.

10 Claims, 15 Drawing Sheets

CABLE LOCK

BACKGROUND OF INVENTION

1. Field of the Invention

The present invention relates to a cable lock that includes an adjustable closed loop. The cable lock secures an object by virtue of looping the object and adjusting the size of the closed loop where necessary.

2. Description of the Prior Art

U.S. Pat. No. 6,470,718 (denoted as '718) to Yang describes a cable lock composed mainly of a belt and a lock body. The belt can pass through the interior of the lock body, which is in connection to an end of the belt, to form a closed loop to be secured on an article. After adjusting the size of the closed loop to prevent the release of the locked article, the belt is then locked by the lock body and makes it be secured by the cable lock.

According to the structure of the cable lock disclosed in the '718 patent, when the adjustment of the size of the closed loop is completed and a locked condition is reached, the belt can be pulled along a direction to reduce the size of the loop. In other words, the size of the closed loop cannot be kept constant in the locked condition. In practice, the locked article may be damaged by the belt or the lock body, when the belt is pulled to make the size smaller. As a result, the article can become damaged easily. Thus, it can be seen that, the reducible size of the closed loop when the cable lock is in the locked condition is a drawback concerning articles of value.

In addition, as disclosed in the '718 patent, the belt, passing through the lock body, must have one of its ends inserted in advance into a slot disposed on the lock body to constitute the closed loop. The slot of the lock body is an aperture that allows the perpendicular insertion of an extremity of the belt in a particular direction. In other words, the extremity of the belt must accurately face the slot so that the belt can be inserted into the lock body so that it can be locked. It may be difficult for a user to apply the cable lock when such an accurate operation is required.

SUMMARY OF INVENTION

It is therefore a primary objective of the present invention to provide a cable lock wherein the size of the closed loop can be kept fixed after being locked. In addition, the lock body provides a slot that allows the extremity of the belt to be inserted easily, reducing the dexterity required by the user.

To achieve the aforementioned goals, an improved cable lock structure is provided in the present invention, including a lock body and a belt, a hole which is disposed on the lock body to allow the sliding and passing therethrough of the belt, and a slot disposed to a side of the lock body to allow the insertion of the belt extremity. The lock body has a combination lock mechanism, a first clamp member, and a second clamp member disposed thereon. After the adjustment of the size of the closed loop formed by the lock body together with the belt is complete, the first and the second clamp member are utilized respectively to provide a holding effect on the extremity of the belt inserted into the slot and on the part positioned inside the hole. Afterwards, the combination lock mechanism is then switched to a locked status to confine the positioning of the first and second clamp members so that the size of the closed loop cannot be reduced or enlarged.

Furthermore, the lock body according to the present invention further has slot with an enlarged slot opening to offer a broader angle for the insertion of the belt extremity.

In practice, the lock body of the cable lock according to the present invention can further include a key tube, a third clamp member, and a fourth clamp member to achieve the goal. Similarly, after the adjustment of the size of the closed loop formed by the lock body together with the belt is complete, the third and the fourth clamp members are utilized respectively to provide a holding effect on the extremity of the belt inserted into the slot and on the part positioned inside the hole. Afterwards, the combination lock mechanism is then switched to a locked status to confine the positioning of the third and fourth clamp members so that the size of the closed loop cannot be reduced or enlarged.

These and other objectives of the present invention will no doubt become obvious to those of ordinary skill in the art after having read the following detailed description of the preferred embodiment that is illustrated in the various figures and drawings.

DETAILED DESCRIPTION

Figure 1:
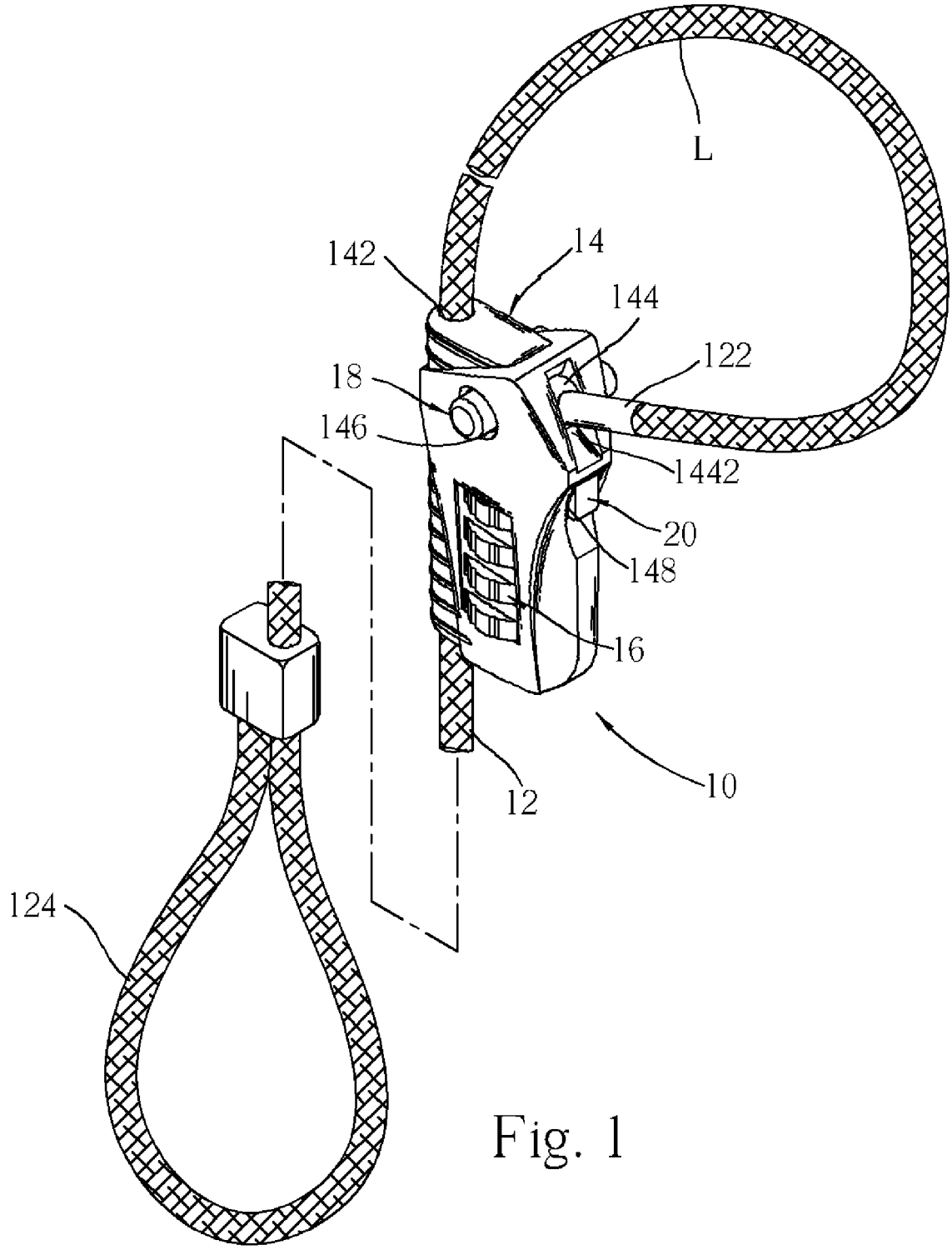
FIG. 1 is a perspective diagram of a cable lock according to a preferred embodiment of the present invention.
Figure 2:
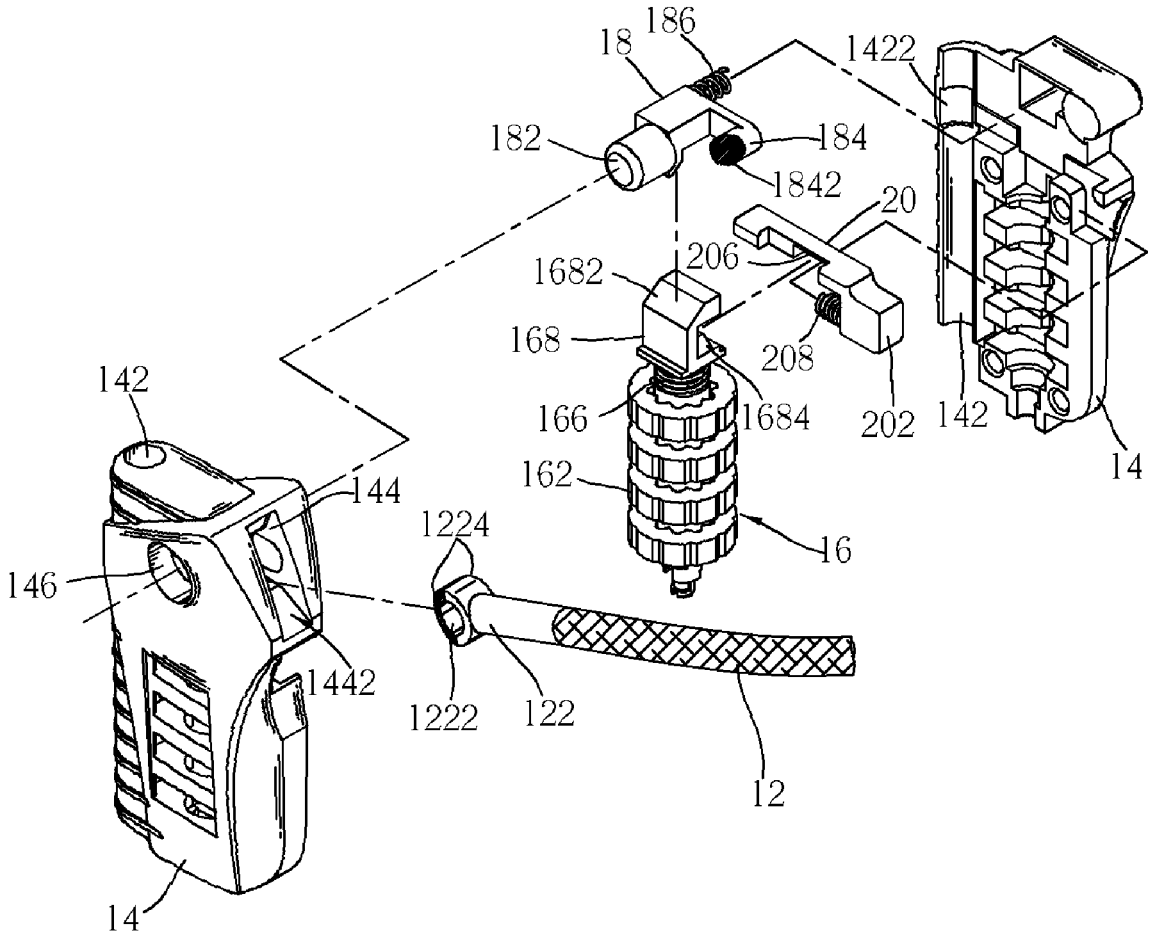
FIG. 2 and FIG. 3 are different views of exploded diagrams of a cable lock according to the present invention.
Figure 3:
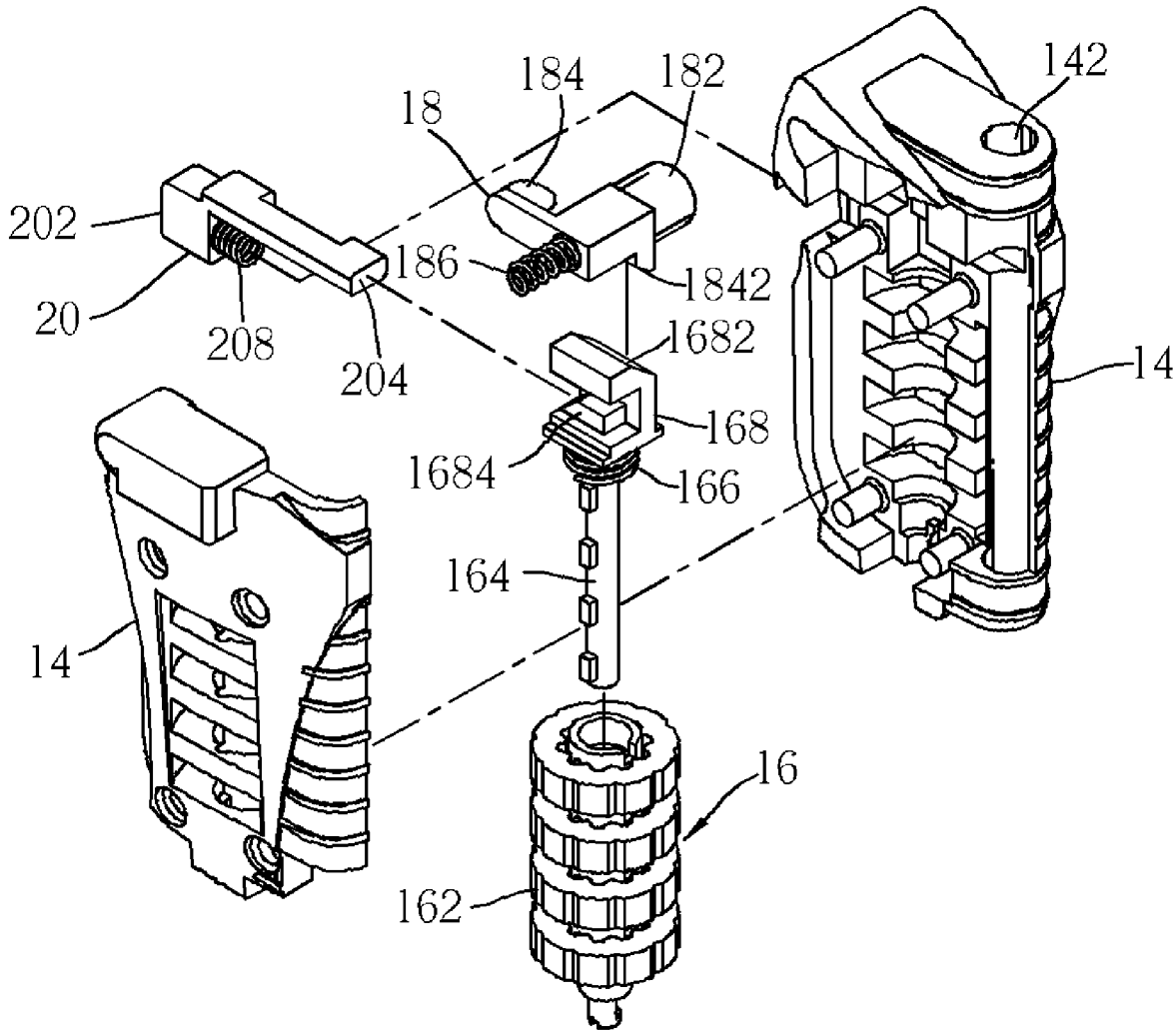

Please refer to FIG. 1 to FIG. 3. The cable lock 10 according to the present invention includes a belt 12, a lock body 14, a combination lock mechanism 16 positioned on the belt 12, a first clamp member 18 and a second clamp member 20. The characteristics and relationship between each member are described as follows.

The belt 12 can be, but is not limited to, a cable or a steel rope with suitable length and flexibility. A buckle member 122 is disposed at an extremity of the cable while a ring 124 is disposed at the other extremity so that the belt 12 can be secured on a fixed article. The lock body 14 can include a plurality of shell bodies, and has a hole 142 disposed at a lateral side thereof to allow the sliding and passing therethrough of the belt 12, and a slot 144 positioned at another side for supporting the insertion of the buckle member 122 so that the belt 12 together with the lock body 14 are allowed to constitute a closed loop L.

The combination lock mechanism 16 is disposed on the lock body 14. As shown in the figure, the combination lock mechanism 16 includes a plurality of dialing wheels 162 disposed on the lock body 14, a shaft 164 which can move in the axial direction, and a repositioning resilient member 166. The dialing wheel 162 is exposed partly outside the lock body 14 to allow dialing, and with the dialing of the dialing wheel 162 the shaft 164 can be determined to be in an axially-moveable state or restricted to a fixed position. Normally, the shaft 164 is kept in position by means of the repositioning resilient member 166. In addition, a latch block 168 extends from the extremity of the shaft 164, and an inclined guide plane 1682 and a bulge 1684 can be defined on the latch block 168. Since the combination lock mechanism 16 is conventional, no further description is provided here.

The first clamp member 18 is disposed on the lock body 14 and has a first button 182 corresponding to a bore 146 positioned on the lock body 14 and a fastener 184 extended from the interior of the slot 144 positioned on the lock body 14. The first clamp member 18 is in connection with a first resilient member 186 for allowing the first button 182 to protrude from the bore 146 and to be exposed outside the lock body 14, and in the meanwhile, allowing the fastener 184 to be kept in a position which buckles (i.e. holds) the buckle member 122 inserted into the slot 144. The first clamp member 18 can, with the help of the first button 182, switch to a position where the fastener 184 releases the buckle member 122, and act on the inclined guide plane 1682 of the latch block 168 to result in the axial displacement of the latch block 168 as well as the shaft 164. In addition, an inclined guide plane 1682 is further included on the first clamp member 18 to contact (i.e. press) the inclined guide plane 1682 of the latch block 168 as a contact plane when moving together with the latch block 168.

The second clamp member 20 is a member disposed on the lock body 18 with a second button 202 corresponding to another bore 148 of the lock body 14 to form a pressing plane 204 which holds the belt 12 inside the hole, and a rabbet 206 for positioning. The second clamp member 20 acts in connection with a second resilient member 208 for allowing the second button 202 to protrude from the bore 148 and to be exposed outside the lock body 14, and in the meanwhile, allow the pressing plane 204 to be kept in a position where the belt 12 is not yet held. The second clamp member 20 can be pushed to make the pressing plane 204 hold the belt 12 positioned inside the hole, and in the meanwhile, the rabbet 206 will precisely reach the position where it mates (inlays) with the bulge 1684 of the latch block 168, and by means of the latch block 168 keep its position.

Figure 4:
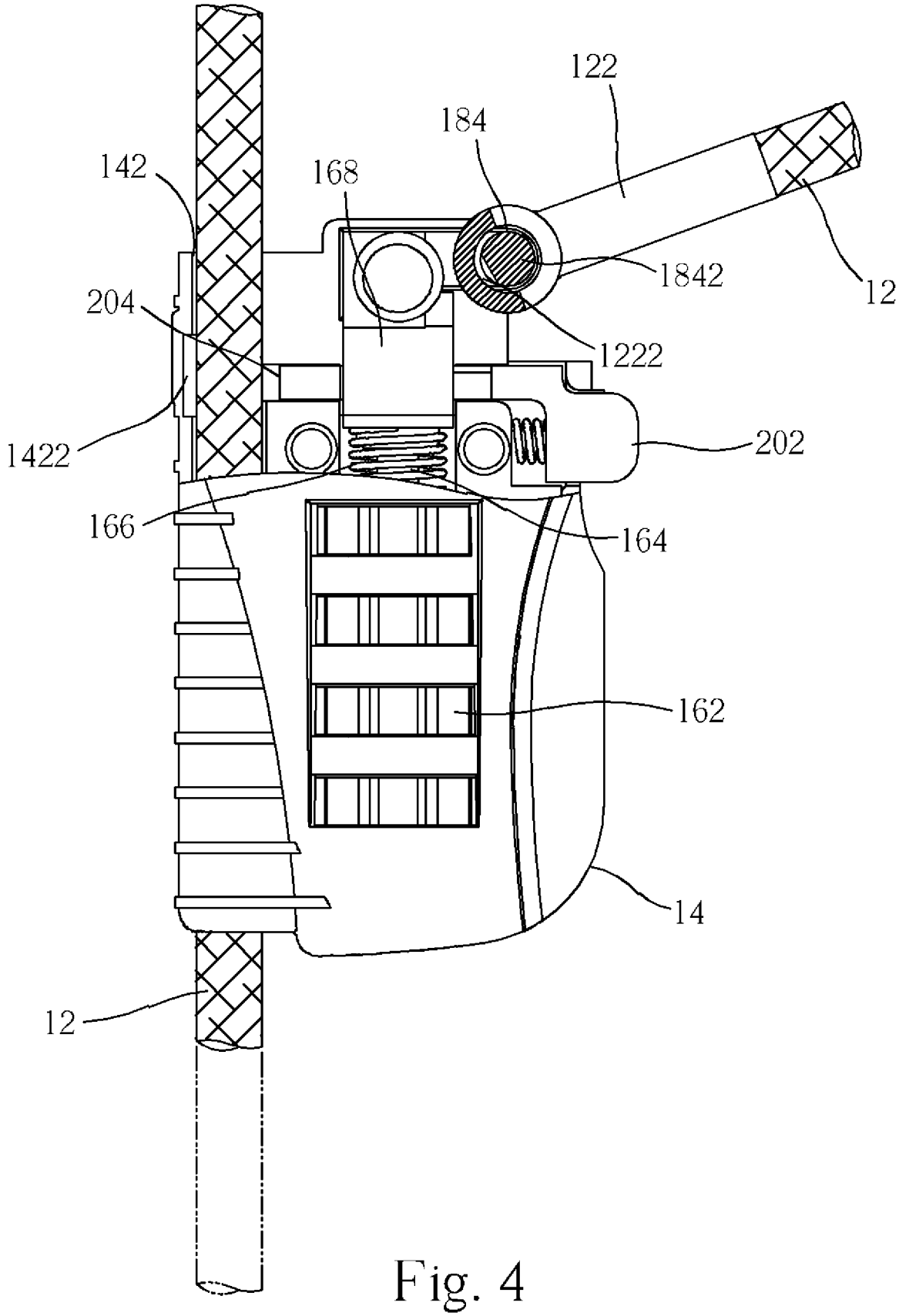
FIG. 4 and FIG. 5 are local sectional views representing different operation situations of a cable lock according to the present invention.
Figure 5:
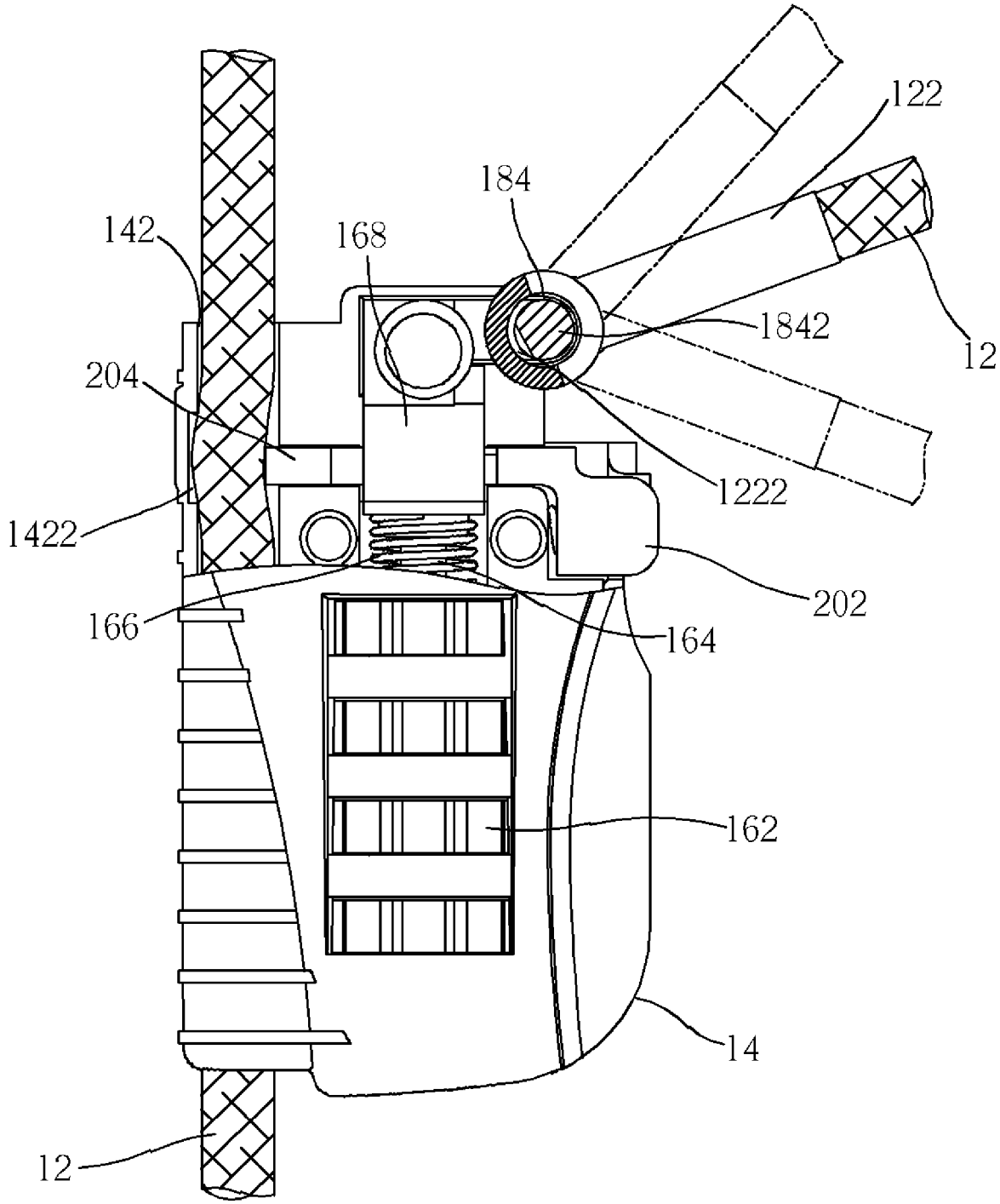
Figure 6:
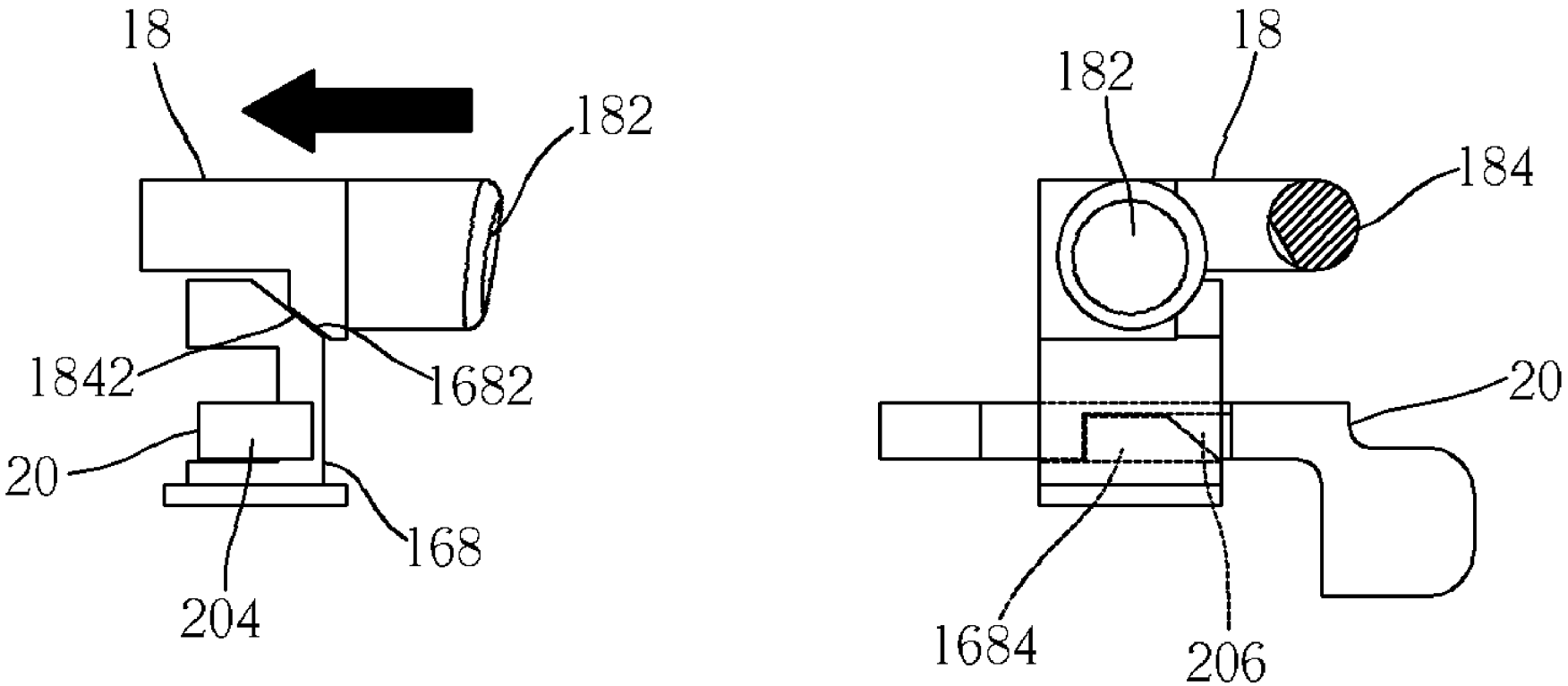
FIG. 6 and FIG. 7 are front view and side view of a local structure of a cable lock according to the present invention so that the different corresponding positions of the operation can be shown.
Figure 7:
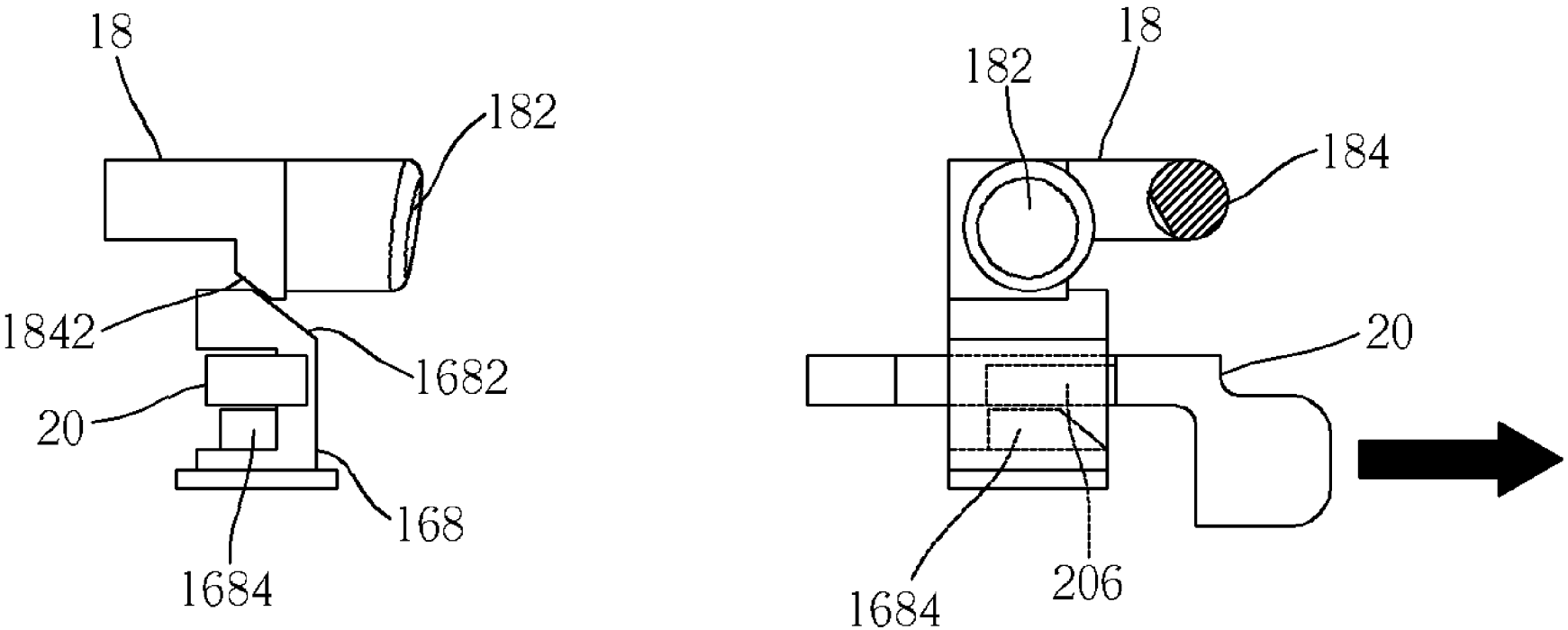

Please refer to FIG. 4 and FIG. 5. In practice, all the dialing wheels 162 of the combination lock mechanism 16 can be switched to a predetermined position so that both the latch block 168 and the shaft 164 can move in the axial direction simultaneously. This is the so-called unlocked status. Please also refer to FIG. 6 and FIG. 7. For the time being, after a locked article is secured by the lock body 14, by applying force to the first button 182, the fastener 184 is then prompted to move together to a position which allows the buckle member 122 of the belt 12 to be inserted into the slot 144. Then, after releasing the force applied on the first button 182, the fastener 184, with the help of the first resilient member 186, will return to the initial position and will be inserted into the bore 1222 of the buckle member 122 to buckle the buckle member 122.

It can be seen that the fastener 184 is used for immobilizing the buckle member 122 which is attached to the extremity of the belt 12. In addition to applying a force to the first button 182 to cause the insertion of the buckle member 122 into the slot 144, the inclined plane 1842 of the fastener 184 can also be considered as an pressing plane for the insertion of the buckle member 122 which can then be directly inserted into the slot 144. By way of pressing on the inclined plane 1842, the force which pushes the buckle member 122 inward will be converted into the force perpendicular to the direction of the applied force so that the fastener 184 will be forced to shift backward. After the buckle member 122 is inserted into a position where it faces the fastener 184, the fastener 184 can go back to the position where it has been inserted into the bore 1222 with the help of the repositioning force provided by the first resilient member 186 so that the buckle member 122 will be fastened. Additionally, an inclined plane 1224, being corresponding to the inclined plane 1842 press against the fastener 184, can also be provided on the surface of the buckle member 122 which is inserted into the slot 144.

The slot 144 of the lock body 14 has an enlarged slot opening 1442 which provides the slot 144 a broader opening for the insertion of the buckle member 12. Furthermore, after the tip of the belt 12 is inserted into the slot 144, the fastener 184 can serve as a rotational axis to allow the buckle member 122 to rotate relative to the lock body 14.

When the insertion of the buckle member 122 into the lock body 14 is complete, the belt 12 can move relative to the hole 142 to regulate the size of the closed loop L. After the size of the size is determined, a force can be applied to the second button 202 of the second clamp member 20 to make the button 202 move to a position where the pressing plane 204 holds the belt 12 inside the hole 142. The belt 12 is then fixed and cannot be moved relative to the lock body 14. If any one of the dialing wheels 162 of the combination lock mechanism 16 is switched to a locking position, the movement of the first clamp member 18 and second clamp member 20 is prevented by the shaft 164 which is unable to move due to the displacement confinement of the dialing wheels 162. As a result, the first clamp member 18 and the second clamp member 20 cannot move and the belt 12 thus limits the size of the closed loop L. When all the dialing wheel 162 are switched to the unlocking positions to relieve the displacement confinement of the shaft 164, the first clamp member 18 and second clamp member 20 can then relieve the movement confinement of the belt 12 and allow the buckle member 12 of the belt 12 to be unloaded from the slot 144. This allows the repositioning of the belt 12 corresponding to the hole 142.

The present invention allows the pressing plane 204 to contact and lock the belt 12 to keep the size of the closed loop L from changing. To allow the pressing plane 204 to lock the belt 12 firmly, some examples are described here.

Please refer to the hole 142 of the lock body 14 shown in the figure. There is a notch 1422 disposed inside the hole 142, and the notch 1422 can receive the deformed part of the belt 12 acted on by the second clamp member 20 to make the belt 12 unable to move. Thus, the notch 1422 can enhance the holding ability of the second clamp member 20 over the belt 12.

Figure 8:
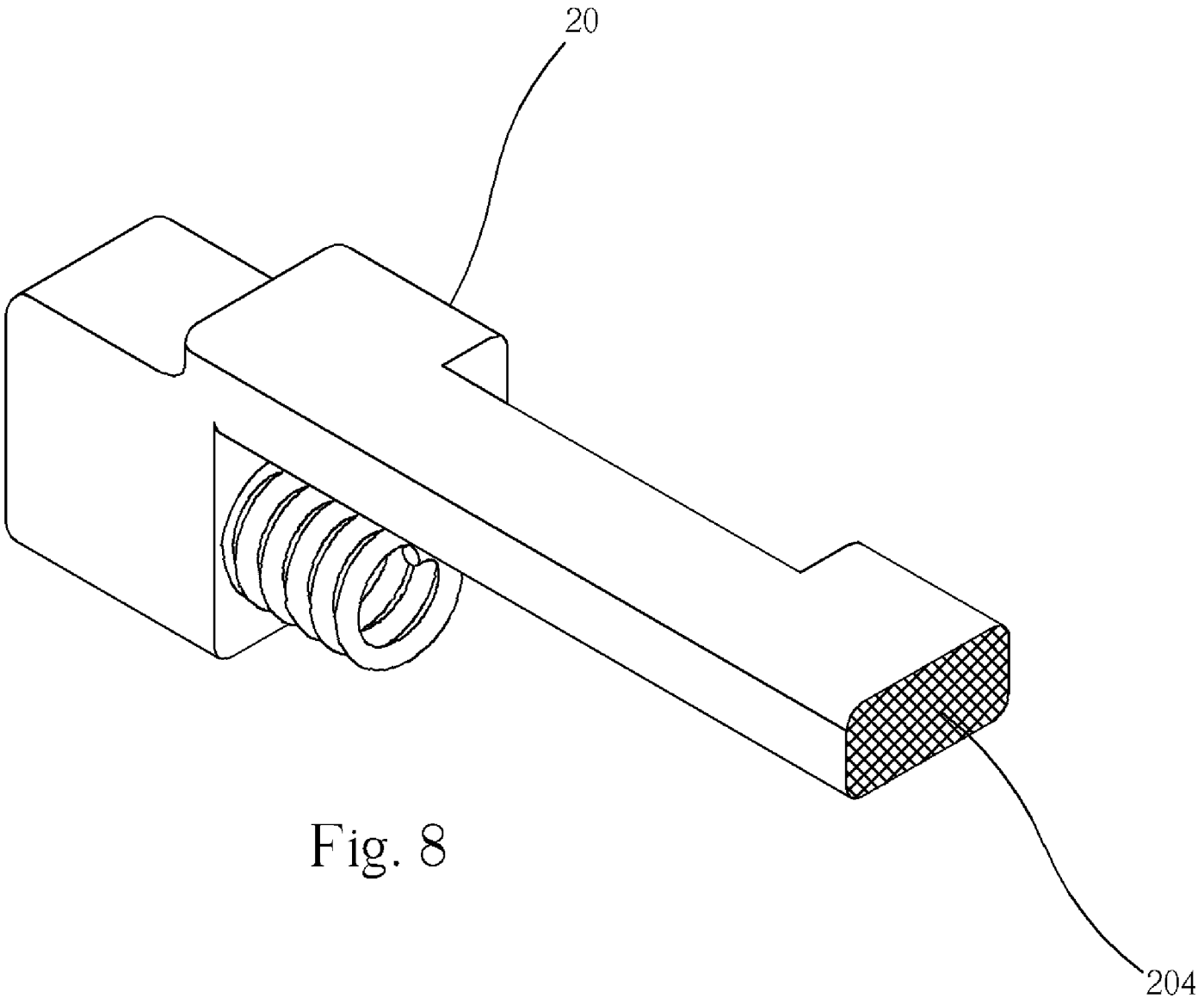
FIG. 8 is a perspective diagram of a second clamp member of a cable lock according to the present invention.

Please refer to FIG. 8, the pressing plane 204 of the second clamp member 20 can be processed to become a rough surface or a non-slip pad with a rough surface to increase the friction force between the pressing plane 204 and the surface of the belt 12. This further enhances the holding ability of fastening the belt 12.

Figure 9:
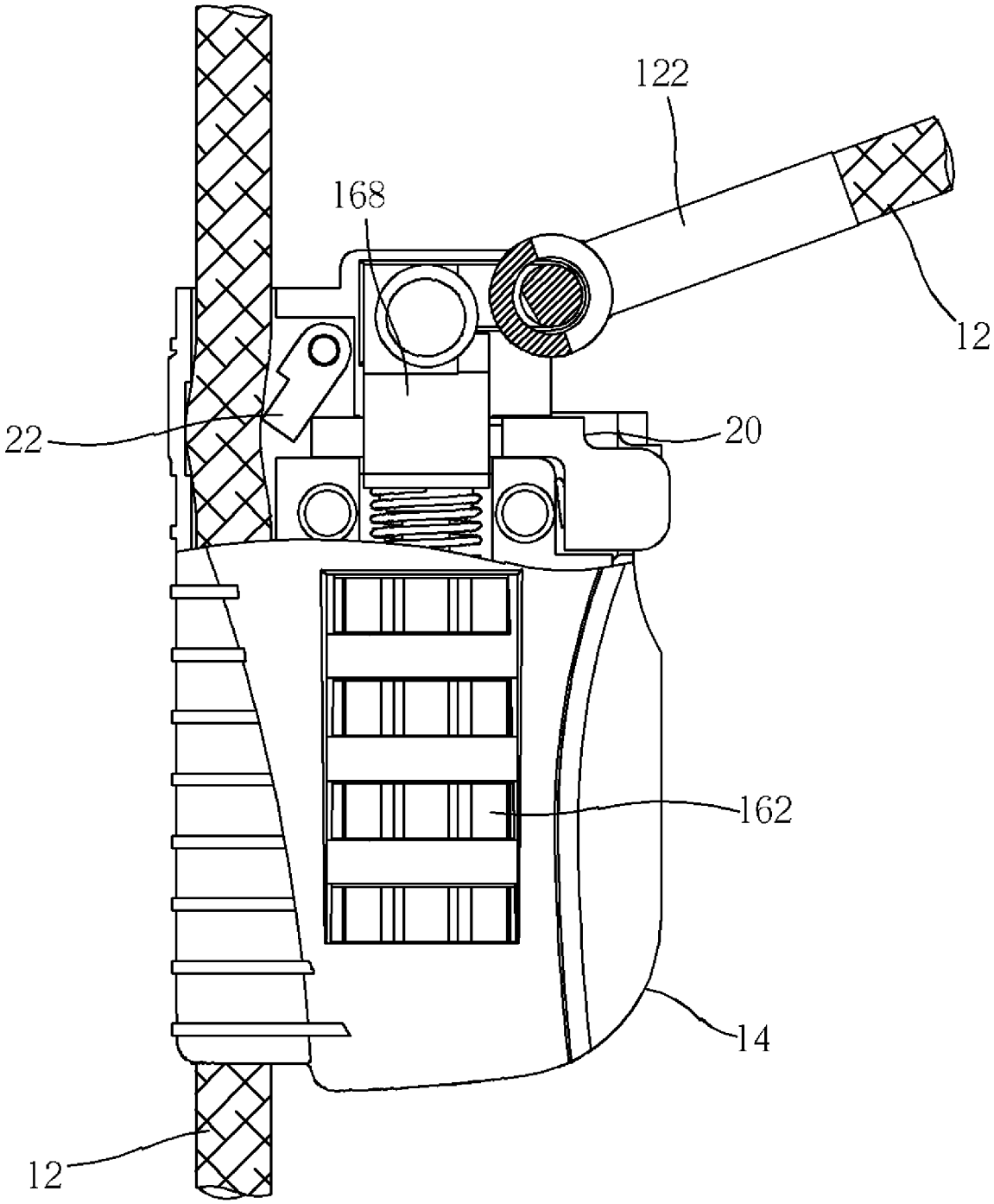
FIG. 9 is a planar schematic diagram showing the structural change of a cable lock according to an embodiment of the present invention.

FIG. 9 is a diagram of a second clamp member 20 which provides the belt 12 with a holding function via an indirect clamp member 22. That is, based on the distance over which the second clamp member 20 holds the belt 12, and taking the performance of the materials used into consideration, the holding effect on the belt 12 can be provided by the indirect clamp member 22.

Figure 10:
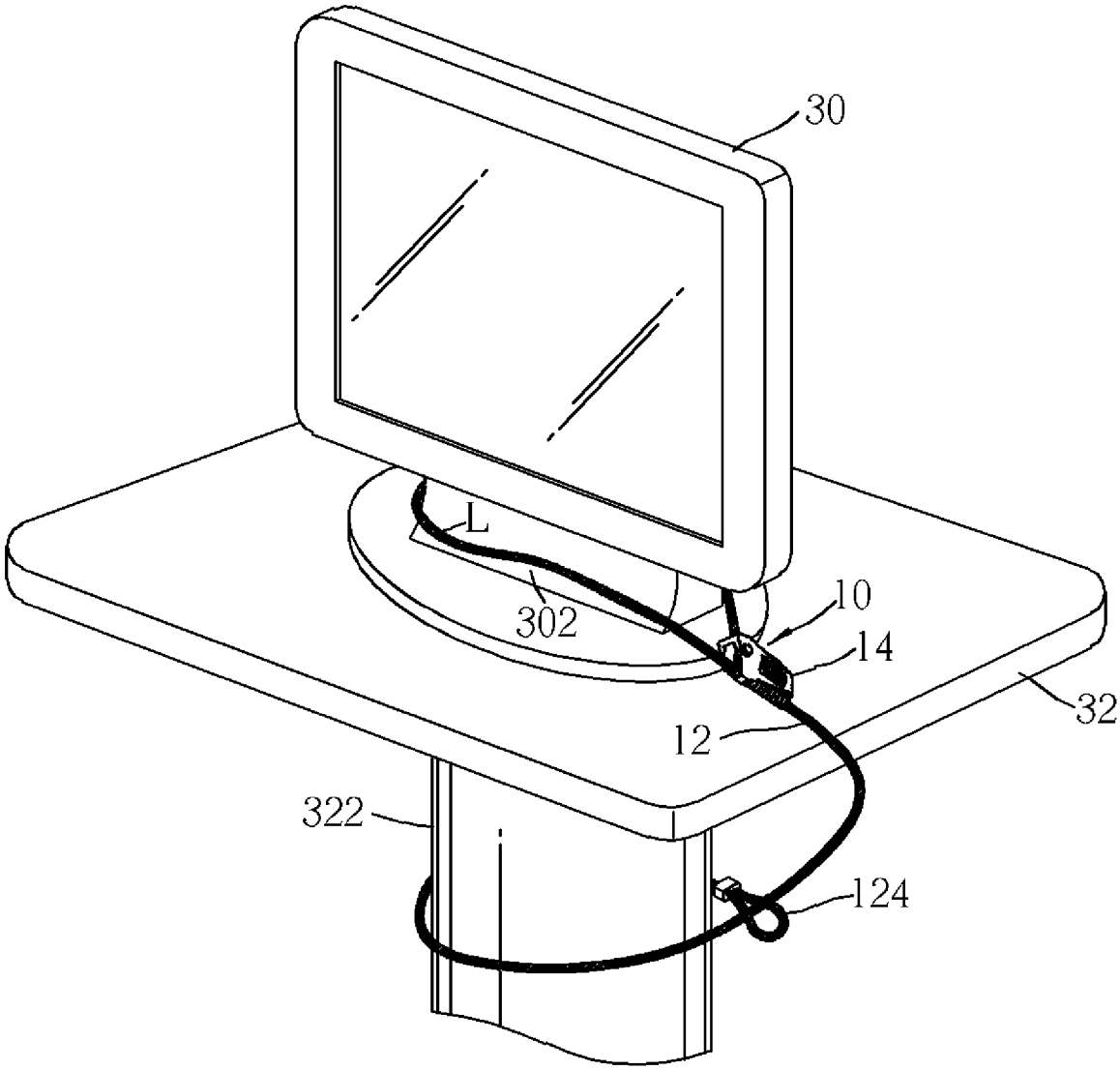
FIG. 10 is a perspective diagram of a cable lock according to an application of the present invention.

FIG. 10 shows a computer monitor 30 locked onto a desk 32 according to the present invention. As shown in the figure, the cable lock 10 according to the present invention can be secured on a desk pillar 322. The buckle member 122 is allowed to bypass the neck 302 of the monitor 30 and is inserted into the slot 144 of the lock body 14 to constitute a closed loop L. The size of the closed loop L is adjusted to an appropriate size and the second clamp member 20 is pushed to the position of which it holds the belt 12. Finally, as long as the combination lock mechanism 16 is in a locked status by the positions of the dialing wheel 162, the size of the closed loop L is fixed and the monitor 30 is locked to the desk 32 via the cable lock 10.

Figure 11:
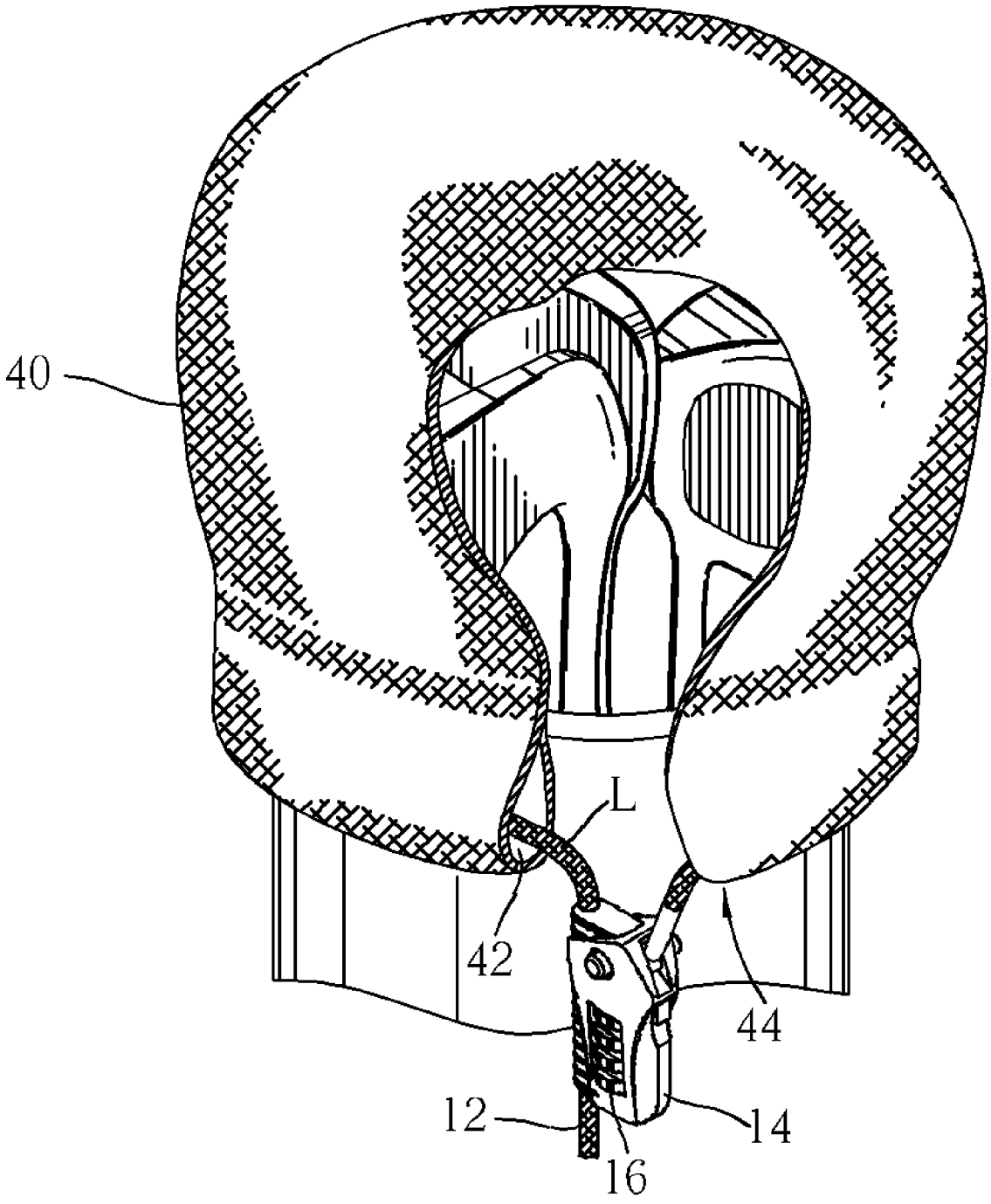
FIG. 11 is a perspective diagram of a cable lock according to another application of the present invention.

FIG. 11 shows the application of the present invention to a container such as a bag. Taking the golf club bag 40 shown in the figure as an example, the belt 12 of the cable lock 10 according to the present invention passes through the coil 42 of the bag 40, and bypasses along a bag opening 44. Afterwards, the combination lock mechanism 16 is unlocked, and the bag opening 44 can be reduced or enlarged by means of adjusting the size of the closed loop L. Therefore, the bag opening 44 can be tightened or loosened. When reducing the bag opening 44 to a size too small to take out anything, the combination lock mechanism 16 can be set to the locked status and the contents of the bag 40 will be safely kept inside. The belt 14 can be secured onto an fixed article in advance by means of the ring 124 so that the bag 40 is connected to a fixed article by the cable lock 10. If the bag opening 44 is merely tied and locked, however, the ring 124 is unnecessary.

Figure 12:
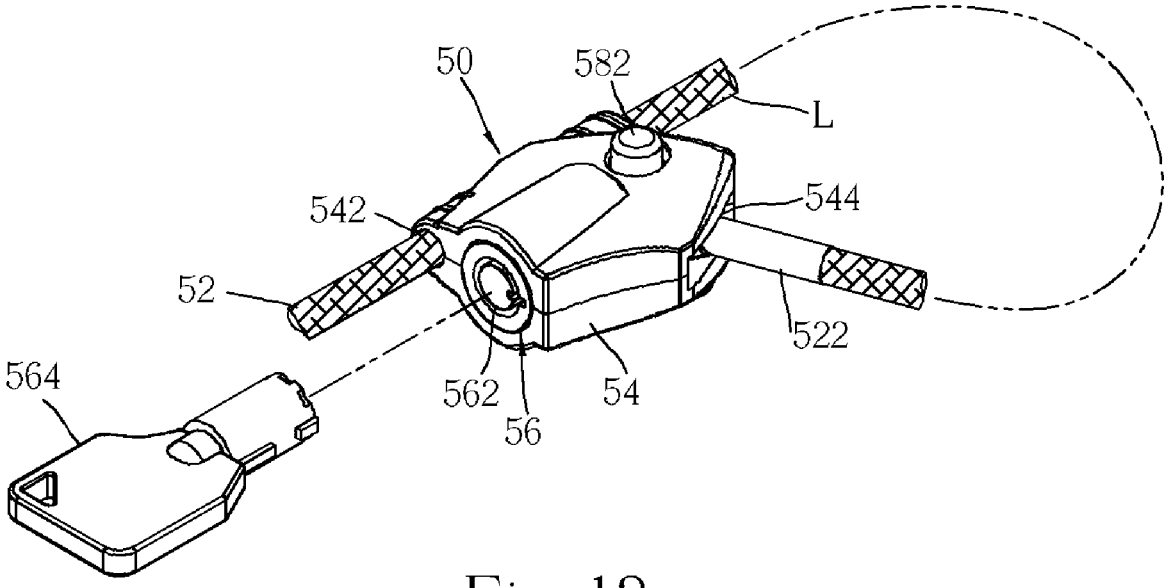
FIG. 12 is a perspective diagram of a cable lock according to another preferred embodiment of the present invention.
Figure 13:
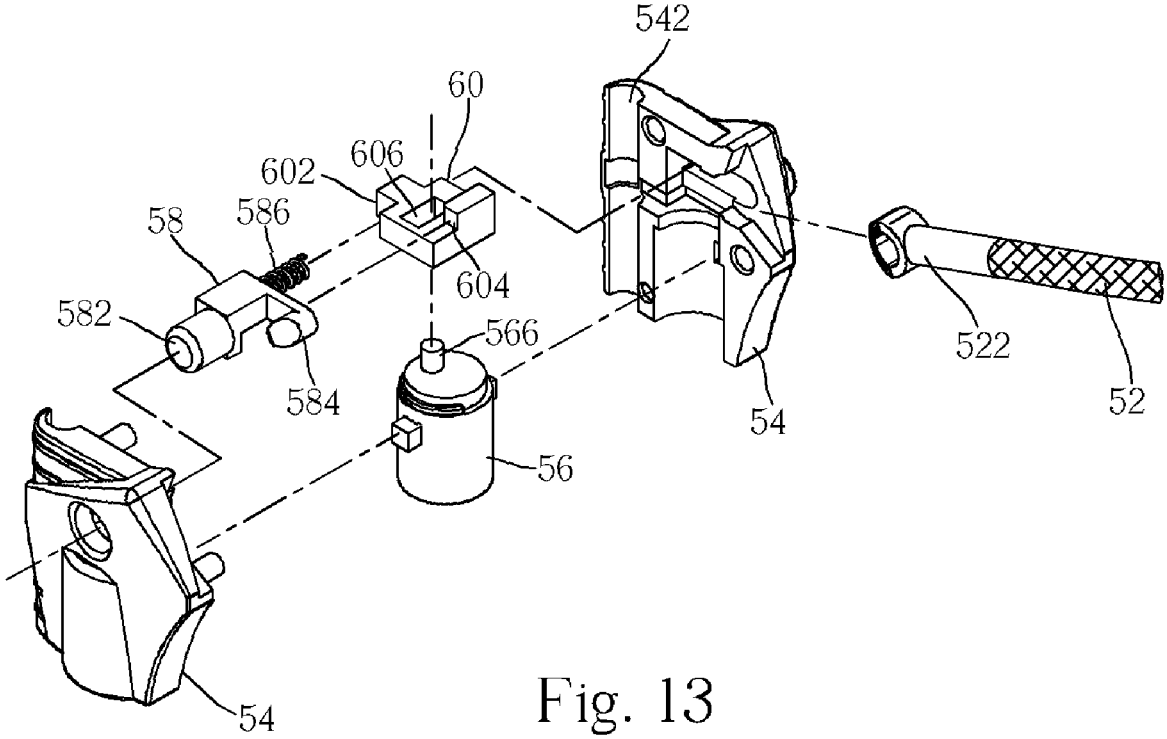
FIG. 13 is an exploded diagram of a cable lock according to another embodiment of the present invention.

Please refer to FIG. 12 and FIG. 13. In comparison with the aforementioned combination lock mechanism 16, a cable lock 50 according to the present invention is disclosed wherein a key tube 56 is used for conversion between locked and unlocked statuses. As shown in the figures, the cable lock 50 of the embodiment includes a belt 52, a lock body 54, a key tube 56, a third clamp member 58, and a fourth clamp member 60. The characteristics and connections are illustrated one by one as follows.

The belt 52 can be, but is not limited to, a cable or a steel rope with suitable length and flexibility. A buckle member 522 is disposed at one end of the cable while a ring 124 is disposed at the other end so that the belt 52 can be secured on a fixed article. The lock body 54 can include multiple shell bodies, and has a hole 542 disposed at a lateral side thereof so that the belt 52 can slide and pass therethrough, and a slot 544 positioned at another side for supporting the insertion of the buckle member 522. The belt 52 together with the lock body 54 can form a closed loop L. Since the assembly and detailed characteristics of the belt 52 and the lock body 54 are the same as the aforementioned embodiment, no further description is provided here.

Figure 14:
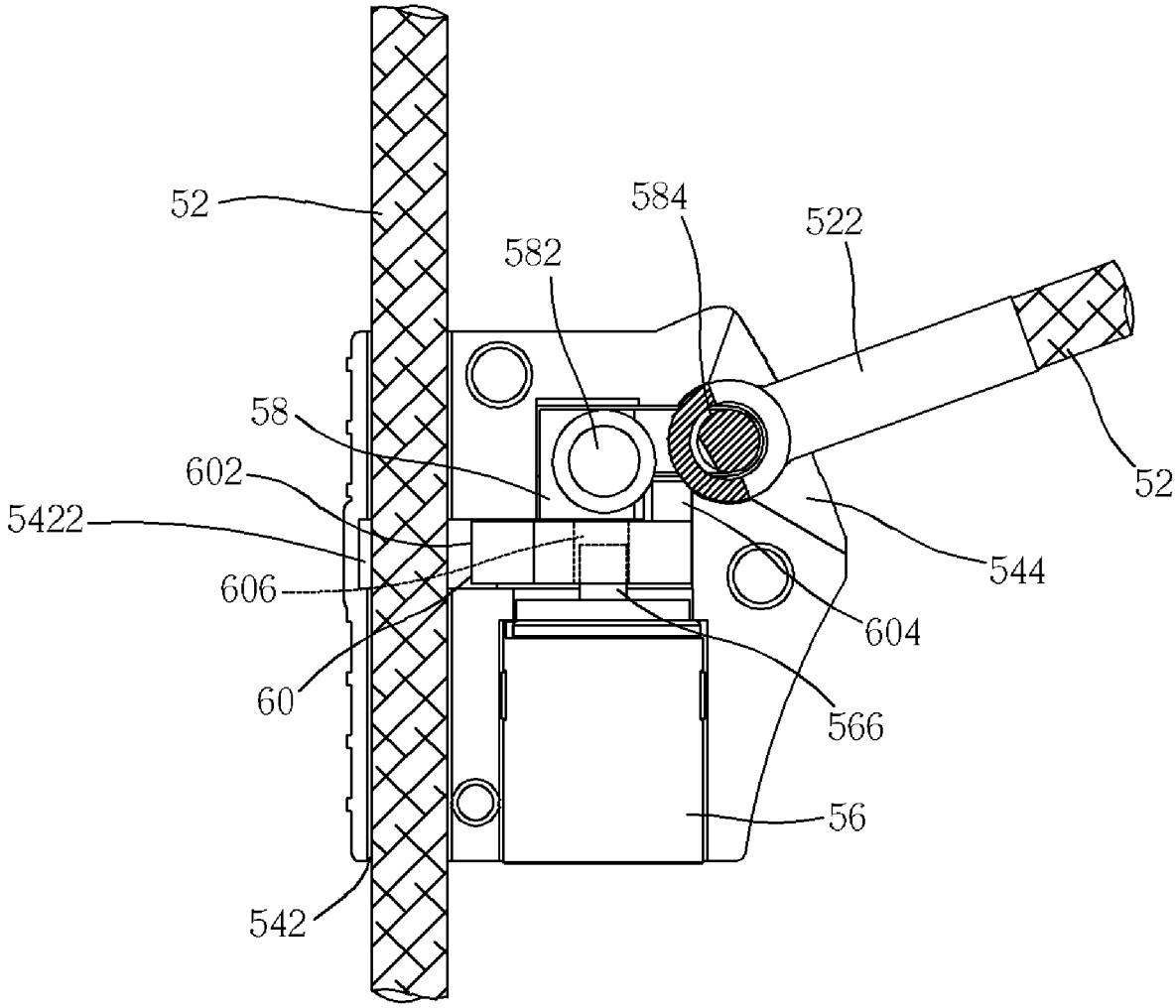
FIG. 14 and FIG. 15 are sectional views showing positions of operation of a cable lock of another embodiment of the present invention.
Figure 15:
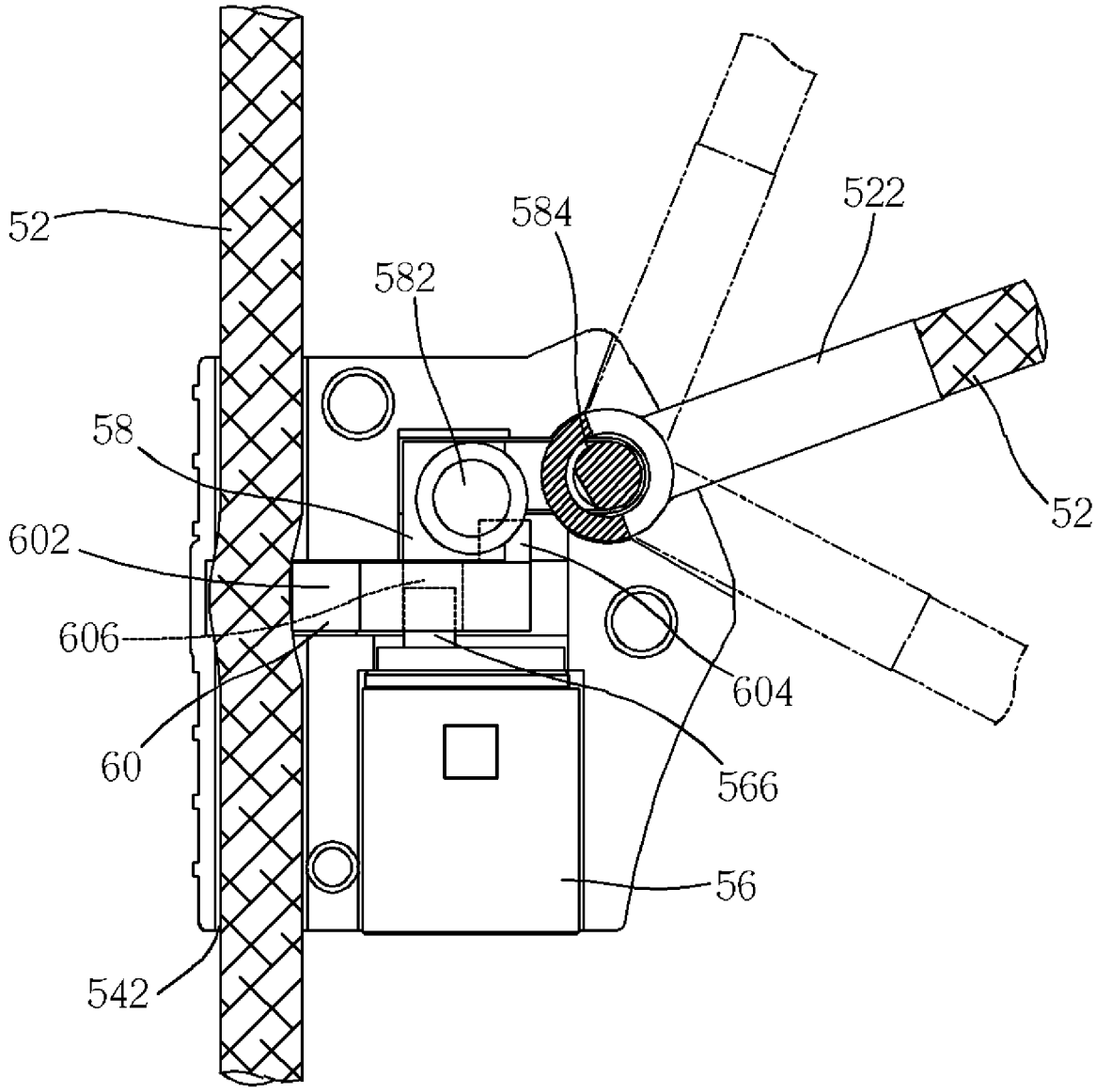

The key tube 56, which is a rotatable member disposed in the lock body 54, has an end surface exposed outside the lock body 54 and a key aperture 562 disposed thereon to allow the insertion of a key 564 which can be operated rotationally. The key tube 56 has an unlocked position as shown in FIG. 14, and a locked position as shown in FIG. 15. An eccentric shaft 566 is disposed to the other end surface of the key tube 56 to move together with the fourth clamp member 60.

The third clamp member 58 is disposed on the lock body 54 and has a button 582 and a fastener 584 extending from the interior of the slot 542 positioned on the lock body 54. The third clamp member 58 is in connection with a third resilient member 586 for allowing the fastener 584 to be kept in a position which buckles (i.e. holds) the buckle member 522 positioned at an extremity of the belt 12. In addition, the third clamp member can shift to a position where the fastener 584 releases the buckle member 522.

The fourth clamp member 60 is disposed on the lock body 54 as well and has an pressing plane 602 and a stopping plane 604 defined thereon. The fourth clamp member 60 also has an elongated hole 606 to provide the insertion of the eccentric shaft 566 of the key tube 56. The key tube 56 can be allowed to move rotationally causing the fourth clamp member 60 to displace rectilinearly.

Please refer to FIG. 14. When the key tube 56 is driven and switched from an unlocked position to a locked one, the fourth clamp member 60 is driven by the eccentric shaft 566 synchronously and makes the pressing plane 602 resist the belt 52 positioned inside the hole 542, and further make the stopping plane 604 move to a position which blocks the releasing of the buckle member 522 by the third clamp member 58.

Please refer now to FIG. 15. When the key tube 56 is driven and switched from the locked position back to the unlocked position, the fourth clamp member 60 is driven by the eccentric shaft 566 as well, and moves to make the pressing plane 602 release the belt 52, and make the stopping 604 release the third clamp member 58 at the same time.

As described above, the cable lock 50 in combination with the key tube 56 can, in a locked status, allow the fourth clamp member 60 to hold the belt 52 positioned inside the hole 542 to make the closed loop L fixed in size.

Additionally, the enhancements of the holding ability of the fourth clamp member 60 against the belt 52 can also be applied similar to the aforementioned second clamp member 20. I.e. the pressing plane can be rough or the lock body 54 can have a notch 5422 disposed in the hole 542.

In conclusion, the two cable locks disclosed in the present invention allow the size of the closed loop, formed by the lock body together with the belt, to be fixed. Moreover, by means of the enlarged slot opening provided in the lock body, the belt can be easily inserted.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A cable lock comprising:

a flexible belt having a buckle member at an end thereof;

a lock body having a hole for the belt to slide into and pass through and a slot for receiving the buckle member, wherein the slot has an enlarged slot opening, the lock body together with the belt capable of forming a closed loop;

a combination lock mechanism having a plurality of dialing wheels disposed on the lock body, a shaft capable of moving axially, and a repositioning resilient member, wherein the shaft is kept positioned by the repositioning resilient member and receives the dialing wheels to confine the axial displacement of the shaft, and wherein a latch block extends from the extremity of the shaft, and an inclined guide plane and a bulge are defined on the latch block;

a first clamp member, disposed on the lock body and having a first button and a fastener positioned inside the slot, being in connection with a first resilient member for allowing the fastener to be kept in a position which buckles the buckle member inserted into the slot, wherein the first clamp member is able to, with the help of the first button, be shifted to a position wherein the fastener releases the buckle member, and acts on the inclined guide plane of the latch block to result in the axial displacement of the latch block together with the shaft; and a second clamp member, disposed on the lock body and having a second button, a pressing plane, and a rabbet, and being in connection with a second resilient member, wherein the second clamp member is able to be pushed to a position which makes the pressing plane hold the belt positioned inside the hole and allows the rabbet to mate with the bulge of the latch block, and wherein after the latch block separates the rabbet and the bulge pushed by the first clamp member, the second clamp member in conjunction with the second resilient member is able to return to a position where the pressing plane relieves the resisting effect on the belt.

2. The cable lock of claim 1, wherein the buckle member has a bore in the fastener and is free to rotate relative to the lock body by taking the bore as an axis of rotation.

3. The cable lock of claim 2, wherein the fastener includes an inclined plane thereon, the inclined plane being able to press directly on the fastener as the buckle member is inserted into the slot and allowing the fastener to move back to a position which allows the buckling motion of the buckle member to complete.

4. The cable lock of claim 3, wherein the buckle member also includes an inclined plane disposed thereon to contact the inclined plane of the fastener.

5. The cable lock of claim 1, wherein the first clamp member further defines an inclined guide plane thereon to contact the inclined guide plane of the latch block.

6. The cable lock of claim 1, wherein an indirect clamp member is disposed inside the lock body for receiving the shifting of the second clamp member to resist the belt positioned inside the hole.

7. The cable lock of claim 1, wherein the bulge has an inclined tangential plane disposed thereon to contact the second clamp member.

8. The cable lock of claim 1, wherein the other end of the belt has a loop to be secured onto an article.

9. The cable lock of claim 1, wherein the pressing plane is a rough surface so as to increase the intrinsic friction force between the second clamp member and the lock body.

10. The cable lock of claim 1, wherein a notch is further disposed inside the hole of the lock body to receive a deformed part of the belt which is resisted by the pressing plane of the second clamp member.

* * * * *